US006838043B1

(12) United States Patent
Wagner et al.

(10) Patent No.: US 6,838,043 B1
(45) Date of Patent: Jan. 4, 2005

(54) METHOD FOR THE PRODUCTION OF A SYNTHETIC LEATHER

(75) Inventors: Rudolf Wagner, Müllheim (DE); Robert Groten, Sundhofen (FR)

(73) Assignee: Carl Freudenberg KG, Weinheim (DE)

( * ) Notice: Subject to any disclaimer, the term of this patent is extended or adjusted under 35 U.S.C. 154(b) by 200 days.

(21) Appl. No.: 10/110,053

(22) PCT Filed: Sep. 1, 2000

(86) PCT No.: PCT/EP00/08548

§ 371 (c)(1),
(2), (4) Date: Jun. 21, 2002

(87) PCT Pub. No.: WO01/25530

PCT Pub. Date: Apr. 12, 2001

(30) Foreign Application Priority Data

Oct. 5, 1999 (DE) ..... 199 47 869

(51) Int. Cl.[7] ..... D01D 5/098; D01D 5/32; D01D 5/42; D04H 3/16; D06M 15/564

(52) U.S. Cl. ..... 264/555; 28/104; 156/167; 264/78; 264/103; 264/147; 264/162; 264/171.24; 264/172.14; 264/210.8

(58) Field of Search ..... 264/78, 103, 147, 264/162, 171.24, 172.14, 210.8, 555; 156/167; 28/104

(56) References Cited

U.S. PATENT DOCUMENTS

| | | | |
|---|---|---|---|
| 4,107,374 | A | 8/1978 | Kusunose et al. |
| 4,147,574 | A | 4/1979 | Setsuie et al. |
| 4,390,566 | A | 6/1983 | Umezawa et al. |
| 4,560,385 | A | 12/1985 | Baravian |
| 5,899,785 | A | 5/1999 | Groten et al. |

FOREIGN PATENT DOCUMENTS

| | | | |
|---|---|---|---|
| EP | 0 090 397 | A2 | 10/1983 |
| EP | 0 624 676 | A1 | 11/1994 |
| EP | 0 952 250 | A1 | 10/1999 |
| WO | 99/24658 | A1 | 5/1999 |

OTHER PUBLICATIONS

"Nouveaux cuirs synthetiques japonais", L'Industrie Textile, France, No. 1255/1256, Jun. 1, 1994, p. 63.

*Primary Examiner*—Leo B. Tentoni
(74) *Attorney, Agent, or Firm*—Kenyon & Kenyon

(57) ABSTRACT

A synthetic leather made of a nonwoven fabric impregnated and/or coated with a polymer, with a surface weight of 100 to 500 g/m$^2$, and a tensile strength greater than 300 N/5 cm in the lengthwise and the crosswise direction, where the nonwoven fabric is made up of melt-spun multi-component endless filaments, aerodynamically stretched and directly laid up to form a nonwoven material, having a titer less than 2 dTex, and wherein the multi-component endless filaments, after preliminary bonding, are split and bonded by at least 90% to produce supermicro endless filaments having a titer less than 0.2 dTex.

11 Claims, No Drawings

METHOD FOR THE PRODUCTION OF A SYNTHETIC LEATHER

The invention relates to a synthetic leather made of a nonwoven fabric impregnated and/or coated with a polymer, with a surface weight of 100 to 500 g/m$^2$, and a tensile strength >300 N/5 cm in the lengthwise and the crosswise direction.

From the document European Patent Application 0 090 397, nonwoven fabrics made of ultrafine, tangled filaments are known, which have a layer structure and can be processed to produce synthetic leather, by impregnating and/or coating them with polymers. Preferably, fibers of the "island-in-sea" type are used as the starting fibers, where the ultrafine fibers are released by dissolving the matrix polymer. Furthermore, the use of splittable starting fibers is also indicated.

The document European Patent Application 0 624 676 discloses nonwoven fabrics made of ultrafine fibers and processes for their production from bicomponent fibers. In this connection, the starting polymers of the bicomponent fibers are supposed to have a difference in melting point of 30 to 180° C., and are spun as multi-segment fibers. The bicomponent fibers, which are deposited to form a fiber layer, are subjected to point calandering, during which only the fiber component with the lower melting point is partially melted and consolidated. In a subsequent step, the nonwoven fabric formed from the multi-segment fibers is split, by at least 70%, into the ultrafine partial segment fibers by mechanical action on the fibers. The nonwoven fabrics obtained in this way achieve tensile strength values in the lengthwise and crosswise direction of a maximum of 260 N/5 cm, and can be used as bed linens, absorbents for sanitary products, such as tissues, diapers, filling for sleeping bags, artificial leather, thermal insulation materials, and other purposes.

The invention has set itself the task of indicating inexpensive synthetic leathers with a high tensile strength, as well as a process for their production.

This task is accomplished, according to the present invention, by a synthetic leather that is made of a nonwoven fabric impregnated and/or coated with a polymer, with a surface weight of 100 to 500 g/m$^2$, as well as a tensile strength >300 N/5 cm in the lengthwise and the crosswise direction, where the nonwoven fabric is made up of melt-spun, aerodynamically stretched multi-component endless filaments, with a titer <2 dtex, immediately deposited to form a nonwoven layer, and the multi-component endless filaments, after preliminary bonding, are split by at least 90% to produce supermicro endless filaments with a titer <0.2 dtex, and bonded. Such a synthetic leather demonstrates high tensile strength at a relatively low weight, and is therefore inexpensive. Furthermore, it is similar to natural materials in terms of its feel.

Preferably, the synthetic leather is one in which the multi-component endless filament is a bicomponent endless filament of two incompatible polymers, particularly a polyester and a polyamide. Such a bicomponent endless filament demonstrates, good splittability into supermicro endless filaments and results in an advantageous ratio of strength to surface weight.

Preferably, the synthetic leather is one in which the multi-component endless filaments have a cross-section with an orange-like multi-segment structure, where the segments alternately contain one of the two incompatible polymers. In addition to this orange-like multi-segment structure of the multi-component endless filaments, other arrangements of the incompatible polymers in the multi-component endless filament are also possible, such as a side-by-side arrangement or an arrangement similar to chrysanthemum petals. Such arrangements of the incompatible polymers in the multi-component endless filament have proven to be very well capable of being split.

Preferably, the synthetic leather is furthermore one in which at least one of the incompatible polymers that forms the multi-component endless filament contains an additive, such as dyeing pigments, permanently acting anti-statics and/or additives that influence the hydrophilic or hydrophobic properties, in amounts up to 10 percent by weight. The synthetic leather made up of spin-dyed fibers has a very high resistance to fading at high temperatures. Furthermore, the additives can be used to reduce or prevent static charges, and to improve moisture transport properties.

A synthetic leather in which the nonwoven fabric is impregnated with 10 to 45 percent by weight of a polymer, with reference to the starting weight of the nonwoven fabric, is particularly preferred. For the same or actually superior strength properties of the synthetic leather, a lesser degree of impregnation is required, according to the invention, as compared with previously known products.

The process according to the present invention, for the production of a synthetic leather, includes the steps that multi-component endless filaments are spun from the melt, aerodynamically stretched, and immediately deposited to form a nonwoven layer, that preliminary bonding takes place, and that the nonwoven fabric is bonded by high-pressure fluid jets and, at the same time, split into supermicro endless filaments with a titer <0.2 dtex, and subsequently impregnated and/or coated with a polymer. The synthetic leathers obtained in this way are very uniform with regard to their thickness, they demonstrate an isotropic filament distribution, do not possess any tendency towards delamination, and are characterized by high modulus values.

It is advantageous if the method for the production of the synthetic leather is carried out in such a manner that bonding and splitting of the multi-component endless filaments takes place in that the pre-bonded nonwoven fabric is alternately impacted from both sides with high-pressure water jets, several times. As a result, the starting nonwoven fabric for the synthetic leather demonstrates a good surface and a degree of splitting of the multi-component endless filaments >90%.

It is advantageous if the process for bonding and splitting of the multi-component endless filament is carried out on a unit with rotating screen drums. Such a unit permits the construction of very compact systems.

It is advantageous if the nonwoven fabric, bonded with high-pressure fluid jets and split into supermicro endless fibers, is impregnated with a polyurethane dissolved in dimethyl formamide, and if the polymer coagulates in known manner.

It is especially preferred in the production of the synthetic leather according to the present invention that impregnation of the nonwoven fabric is carried out using an aqueous polyurethane latex dispersion, and coagulation takes place subsequently. This form of impregnation of the starting nonwoven fabric results in no residues of solvent, and is therefore environmentally friendly.

A method in which the multi-component endless fibers are spin-dyed is particularly preferred. Binding the dye into the polymer fibers results in excellent resistance to fading at hot temperatures.

It is furthermore preferred, for various applications, that subsequent treatment by polishing or buffing takes place. In this way, the feel and the surface properties can be improved, and in addition, a so-called "writing effect" can be achieved. "Writing effect" is understood to mean exposure of the microfiber ends at the surface of the synthetic leather, which ends can be oriented in visible manner.

The synthetic leathers produced according to the present invention are particularly well suited for use in the shoe industry, as a material for shoe uppers, interior linings, trim, or heel linings. They are furthermore suitable as clothing materials. Because of their good mechanical strength and, in the case of spin-dyed products, because of their great resistance to fading at high temperatures, the synthetic leathers according to the invention are suited for use in automobile interiors, for the production of dashboards, side paneling, rear window shelves, interior roof coverings, or trunk paneling, and for the production of upholstered furniture, particularly as upholstery materials for armchairs, sofas, or chairs.

EXAMPLE 1

A filament pile with a surface weight of 160 g/m$^2$ is produced from a polyester-polyamide (PES-PA) bicomponent endless filament and subjected to water-jet needle-punching at pressures up to 250 bar on both sides. After the water-jet needle-punching, which results in simultaneous splitting of the starting filaments, the bicomponent endless filaments have a titer <0.2 dtex. The bonded nonwoven fabric is subjected to impregnation with a polyurethane (PUR) dissolved in dimethyl formamide (DMF), where approximately 12 wt.-% PUR are applied, with reference to the starting weight of the nonwoven fabric. The polymer-impregnated nonwoven fabric obtained in this way is surface-ground and finished with special silicones, for example, in order to improve the feel. A synthetic leather with a nubuck-like surface is obtained.

EXAMPLE 2

A filament pile with a surface weight of 110 g/m$^2$ is produced from a PES-PA bicomponent endless filament and subjected to water-jet needle-punching at pressures up to 250 bar on both sides. After the water-jet needle-punching, which results in simultaneous splitting of the starting filaments, the bicomponent endless filaments have a titer <0.2 dtex. The bonded nonwoven fabric is subjected to impregnation with an aqueous polyurethane latex dispersion, where approximately 10 wt.-% PUR are applied, with reference to the starting weight of the nonwoven fabric. The polyurethane is coagulated by treatment with hot water or saturated steam, and subsequently dried and crosslinked at approximately 150 to 160° C. The polymer-impregnated nonwoven fabric obtained in this way is surface-ground and finished with special silicones, for example, in order to improve the feel. A synthetic leather with a nubuck-like surface is obtained.

What is claimed:

1. A method for the production of a synthetic leather, the method comprising the steps of:

spinning multi-component endless filaments from a melt;

aerodynamically stretching the multi-component endless filaments;

directly depositing the multi-component endless filaments to form a nonwoven material;

performing a preliminary bonding step;

bonding the nonwoven fabric by high-pressure fluid jets;

splitting the nonwoven fabric into supermicro filaments having a titer less than 0.2 dTex; and at least one of impregnating and coating the nonwoven fabric with a polymer.

2. The method according to claim 1, wherein the steps of bonding and splitting the multi-component endless filaments includes the steps of alternately impacting the multi-component endless filaments from both sides with high-pressure fluid jets, several times.

3. The method according to claim 2, wherein the steps of bonding and splitting the multi-component endless filament is performed on a unit with rotating screen drums.

4. The method according to claim 1, wherein the step of impregnating the nonwoven fabric is performed using a polymer with a polyurethane dissolved in dimethyl formamide, and wherein the polymer is coagulated.

5. The method according to claim 1, wherein the step of impregnating the nonwoven fabric is performed using a polymer with an aqueous polyurethane latex dispersion.

6. The method according to claim 1, further comprising the step of dyeing the multi-component endless filaments by spin-dyeing.

7. The method according to claim 1, further comprising at least one of the steps of polishing and buffing.

8. The method according to claim 2, further comprising the step of using the synthetic leather as a material for at least one of shoe uppers, interior linings, trim, and heel linings in a shoe.

9. The method according to claim 2, further comprising the step of using the synthetic leather for the production of at least one of dashboards, side paneling, rear window shelves, interior roof coverings, and trunk paneling in an automobile interior.

10. The method according to claim 2, further comprising the step using the synthetic leather in at least one of clothing or as upholstery material for at least one of the armchairs, sofas, and chairs.

11. The method according to claim 1, wherein the impregnating the nonwoven fabric with a polymer occurs with 10 to 45 percent by weight of the polymer, with reference to the starting weight of the nonwoven fabric.

* * * * *

UNITED STATES PATENT AND TRADEMARK OFFICE

CERTIFICATE OF CORRECTION

PATENT NO. : 6,838,043 B1
DATED : January 4, 2005
INVENTOR(S) : Rudolf Wagner

It is certified that error appears in the above-identified patent and that said Letters Patent is hereby corrected as shown below:

Column 1,
Line 4, insert heading -- Field of the Invention --;
Line 4, change “The invention relates” to -- The present invention relates --;
Line 5, change “nonwoven fabric” to -- nonwoven fabric. --;
Lines 5-8, delete “impregnated and/or … direction.”;
Line 9, insert heading -- Background f the Invention --;
Line 18, delete “The document”;
Line 20, change “bicomponent fibers” to -- bi-component fibers --;
Line 21, change “of the bicomponent” to -- of the bi-component --;
Line 24, change ““bicomponent fibers” to -- bi-component fibers --;
Line 37, insert heading -- Description of the Present Invention --;
Line 37, change “The invention has set itself the task of indicating” to -- The present invention provides for --;
Line 40, change “this task is accomplished according to” to -- According to one embodiment of --;
Line 41, change “by a synthetic leather” to -- a synthetic leather is produced --;
Line 47, change “a liter <2 dtex” to -- a liter <2 dTex --;
Line 51, change “<0.2 dtex” to -- <0.2 dTex --;
Lines 56 and 58, change “a bicomponent” to -- a bi-component --;

Column 2,
Line 31, change “<0.2 dtex” to -- <0.2 dTex --;

UNITED STATES PATENT AND TRADEMARK OFFICE

CERTIFICATE OF CORRECTION

PATENT NO. : 6,838,043 B1
DATED : January 4, 2005
INVENTOR(S) : Rudolf Wagner

It is certified that error appears in the above-identified patent and that said Letters Patent is hereby corrected as shown below:

Column 3,
Lines 23-24 and 40, change "bicomponent endless filament" to -- bi-component endless filament --;
Line 27, change "the bicomponent" to -- the bi-component --;
Lines 28 and 45, change "<0.2 dtex" to -- <0.2 dTex --; and
Line 44, change "bicomponent endless filaments" to -- bi-component endless filaments --.

Signed and Sealed this

Eighteenth Day of October, 2005

JON W. DUDAS
*Director of the United States Patent and Trademark Office*